US006170379B1

(12) United States Patent
Taylor

(10) Patent No.: US 6,170,379 B1
(45) Date of Patent: Jan. 9, 2001

(54) DESK AND REMOVABLE BULLET RESISTANT DESK TOP SHIELD

(76) Inventor: James R. Taylor, 19921 E. Micaview, Greenacres, WA (US) 99016

( * ) Notice: Under 35 U.S.C. 154(b), the term of this patent shall be extended for 0 days.

(21) Appl. No.: 09/339,001

(22) Filed: Jun. 23, 1999

(51) Int. Cl.[7] ..... F41H 7/00

(52) U.S. Cl. ..... 89/36.07; 89/36.01; 89/36.04; 312/196

(58) Field of Search ..... 89/36.07, 36.04, 89/36.01, 36.02, 36.05; 108/161, 90; 150/158; 312/196, 194, 140.3, 140.4

(56) References Cited

U.S. PATENT DOCUMENTS

| | | | | |
|---|---|---|---|---|
| 3,848,547 | * | 11/1974 | Scaefer | 89/36.07 |
| 3,866,242 | * | 2/1975 | Slagel | 89/36.07 |
| 4,016,666 | | 4/1977 | Finn et al. | 42/1 J |
| 4,200,677 | | 4/1980 | Bottini | 428/246 |
| 4,674,394 | | 6/1987 | Martino | 89/36.05 |
| 5,326,606 | * | 7/1994 | Labock | 89/36.07 |
| 5,336,848 | | 8/1994 | Katz | 174/35 R |
| 5,506,051 | | 4/1996 | Levy-Borochov et al. | 428/332 |
| 5,554,816 | | 9/1996 | Skaggs et al. | 89/36.17 |

FOREIGN PATENT DOCUMENTS

| | | | |
|---|---|---|---|
| 1584270 | * | 10/1970 | (DE) . |
| 2301671 | * | 10/1976 | (FR) . |
| 2447443 | * | 9/1980 | (FR) . |
| 2558284 | * | 7/1985 | (FR) . |

* cited by examiner

*Primary Examiner*—Peter M. Poon
*Assistant Examiner*—Judith A. Nelson
(74) *Attorney, Agent, or Firm*—Wells, St. John, Roberts, Gregory & Matkin, P.S.

(57) ABSTRACT

A removable bullet resistant desk top is described for releasable attachment to a desk frame. The desk top includes a sheet of bullet resistant material having a top writing surface and a bottom surface. At least one clip is provided, configured to releasably secure the sheet to a desk with the top writing surface facing upwardly.

10 Claims, 6 Drawing Sheets

DESK AND REMOVABLE BULLET RESISTANT DESK TOP SHIELD

TECHNICAL FIELD

The present invention relates generally to protection against personal assault, and more particularly to personal assault protection for those in vulnerable environments such as school rooms.

BACKGROUND OF THE INVENTION

Recent tragic school shootings have led to greater needs to protect our children against future occurrences.

Added security at schools has been proposed and adopted by many school districts in the wake of the recent events.

Use of security personnel may be an effective solution, but few districts can afford the numbers of security personnel needed for effective protection. Once funding is exhausted, security ends and the students are immediately back in a vulnerable situation.

In addition to the on-going cost of security personnel, a "guard house" atmosphere is created by numerous security guards. The same can be true of metal detectors at school entrances.

Yet the need remains for effective, tangible protection for students and others in classroom or group institutional settings. It is also desirable that protection against assailants be made personally available to individual students as an alternative or supplement to additional security personnel.

The present invention represents an improvement in individual protection, and has for a first objective provision of a desk top that may be removed to function as a bullet resistant shield that may be selectively used by an individual against an assault.

Another object is to provide a shield that is configured to function normally in an innocuous mode as an ordinary desk work surface but that can be easily and quickly removed from the desk for use as a personal shield against projectiles including but not limited to bullets, knives, shrapnell, or flying debris that might be encountered in naturally occurring events such as earthquakes, fires, and storms.

A further objective is to provide a removable desk top shield that is configured for use to effectively cover and protect the user's vital organs.

Another objective is to provide a removable desk top shield that may be formed of a transparent material that will not block visibility but that will protect the user's face and head.

These and yet further objects and advantages will be understood from the present specification and drawings which disclose the best mode presently known to the Applicant for carrying out his invention.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
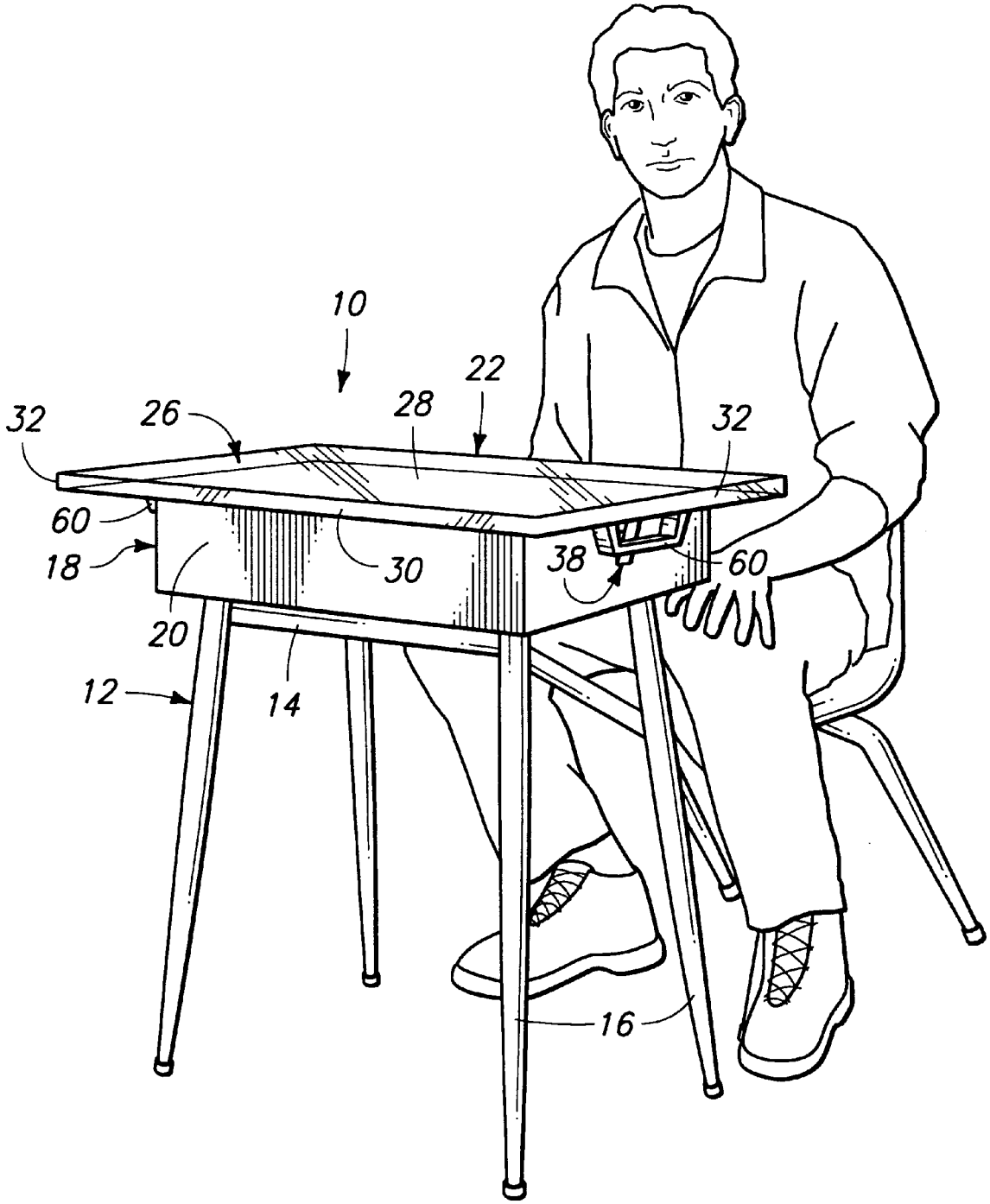
FIG. 1 is a perspective view of a student seated at a desk incorporating a preferred form of the present shield.
Figure 2:
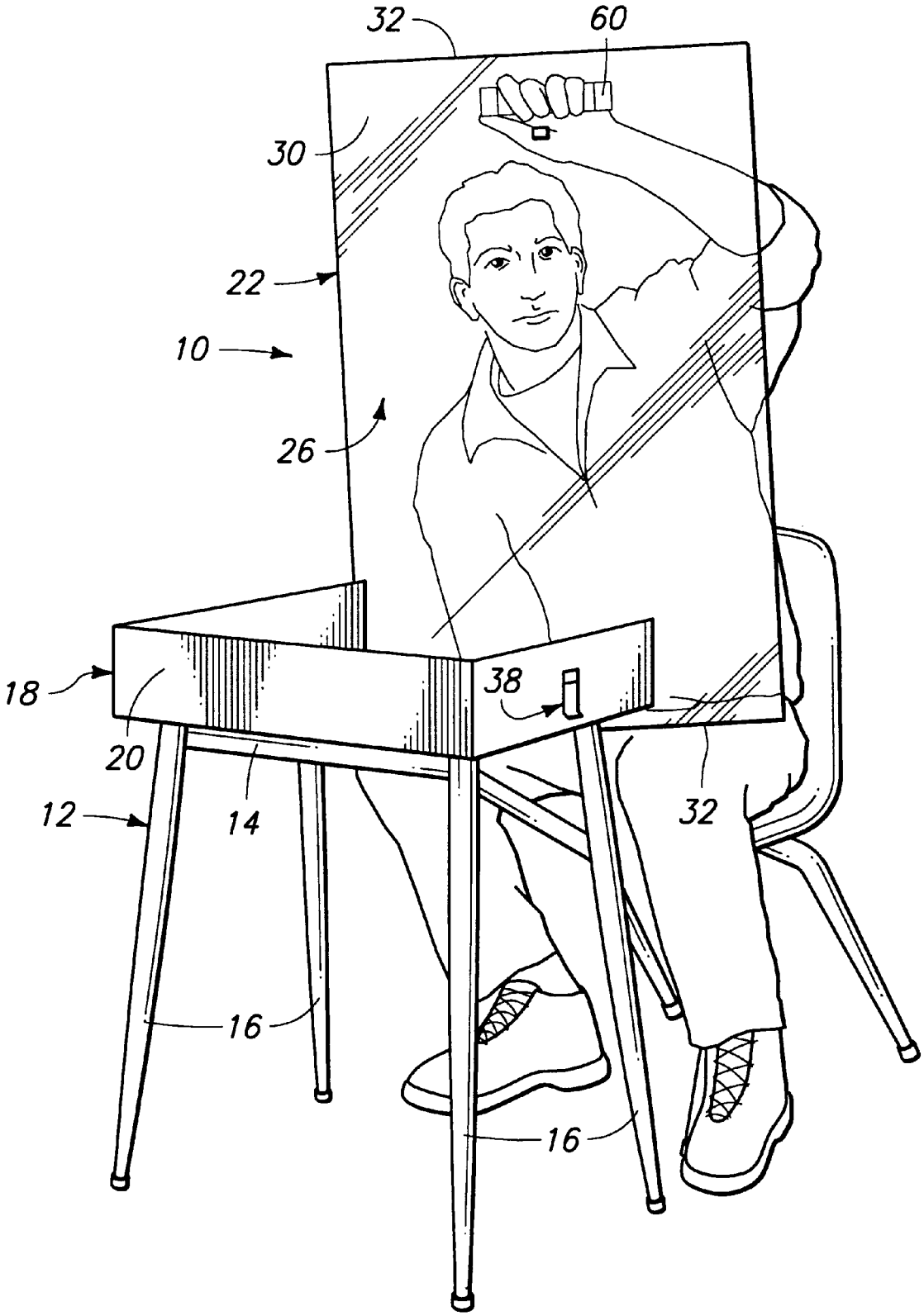
FIG. 2 is a view similar to FIG. 1 only showing the shield removed and held in an operative protective stance.
Figure 5:
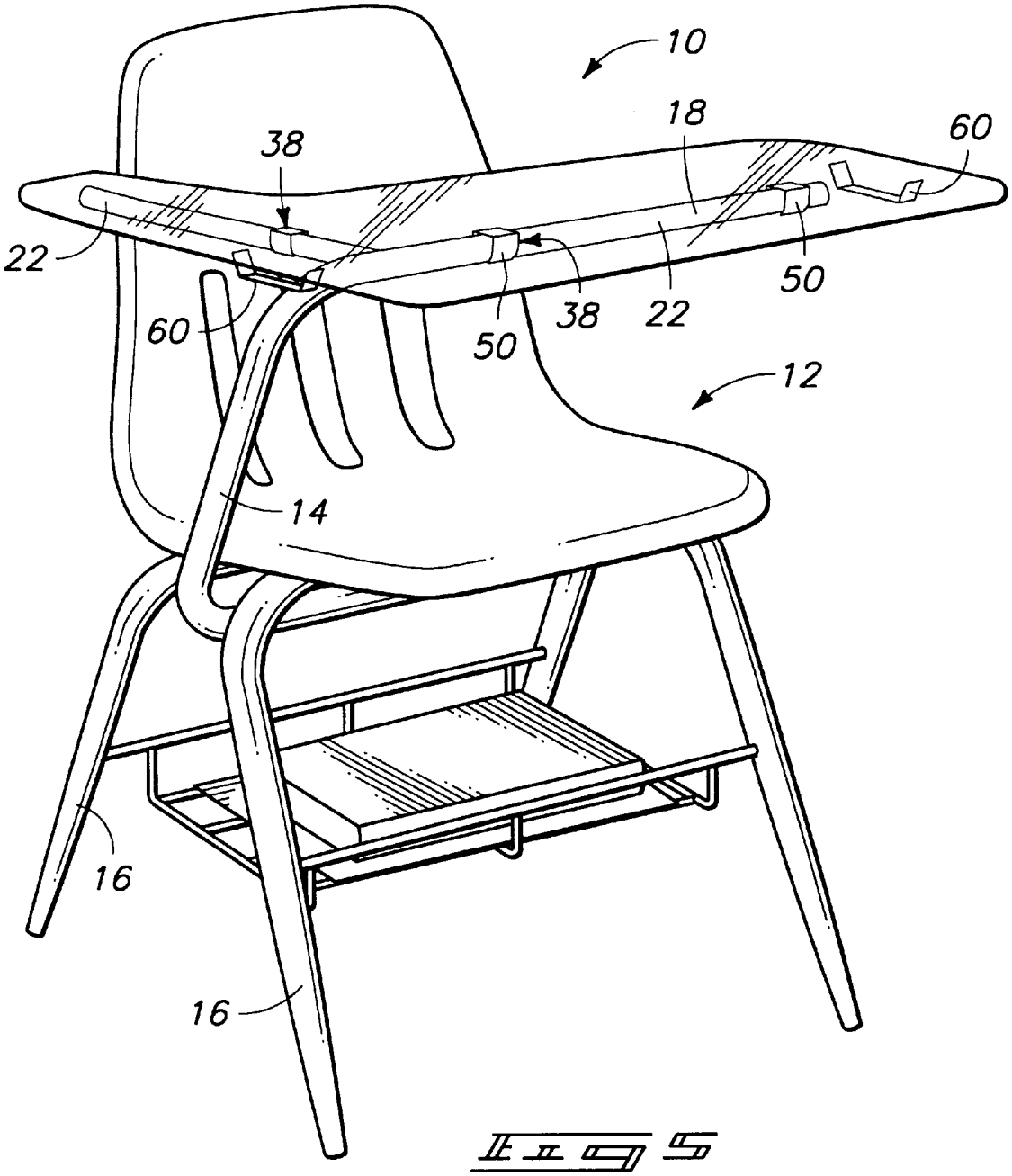
FIG. 5 is a view of an alternate form of desk and a corresponding configuration of the present shield.

Looking now in greater detail to the drawings, a preferred removable bullet resistant desk top shield is generally shown by the reference numeral 10 for releasable attachment to a desk frame 12. As shown in FIGS. 1 and 5, the present shield may be provided in different forms. In preferred exemplary forms, the shield 10 is provided independently as a retrofit structure, for releasable attachment to existing desk frames. In other preferred forms, the shield 10 may be manufactured in combination with desks of various frame configurations. In either form, the shield will be releasably attached to the desk and be easily removable for personal protection (FIG. 2).

Two exemplary embodiments of my invention are represented in FIGS. 1 and 5, each of which may be configured for mounting as a retrofit or to be supplied in combination with desk frames. It should therefor be understood that the shield forms illustrated herein, and the desk frame configurations shown are simply examples of many forms that may be used without departing from the spirit and scope of my invention.

In general, the desk 12 will include a desk frame 14 that may be formed of various materials that are conventional in desk making practices. FIGS. 1 and 5 both show two styles of school desk frames 14 that include legs 16 supporting substantially horizontal top frame sections 18. In the configuration shown by FIG. 1, a compartment 20 is provided along the top frame section 18. In the configuration shown by FIG. 5 no compartment is provided. Instead, tubular frame members 22 are used for desk top support.

In all preferred forms of the present invention, a sheet 26 is provided, formed of a bullet resistant material. The preferred sheet 26 is formed of high impact resistant laminated polycarbonate plastic. One such material is distributed by Sheffield Plastics, Inc., Salisbury Road, Sheffield, Mass. 01257 under the trademark "HyGard BR 750". The preferred sheet includes a thickness dimension of approximately 0.75 inches and includes two 0.125 inch thick layers of "Hyzod" tm brand polycarbonate plastic with abrasion-resistant surfaces, bonded by polyurethane interlayers to a 0.5 inch thick "Hyzod" tm brand polycarbonate sheet. This material is bullet resistant, with a U.L. ballistic rating of 752 Level 1 MPSA.

Another exemplary material for the sheet 26 is disclosed in U.S. Pat. No. 5,506,051 granted to Nicole Levy-Borochov and Murray Figov on Apr. 9, 1996 and which is incorporated by reference in the present application.

It is preferred that the sheet 26 be transparent to enable the user to see an assailant from a protected position as shown in FIG. 2 of the drawings. Colors may be added for decorative purposes, and the sheets may be cut or otherwise formed to standard desk top configurations.

Structurally, the preferred sheet 26 will include a top writing surface 28 and a bottom surface 30. The shape of the sheet perimeter may vary from the generally rectilinear forms illustrated, and may include curved, interrupted or continuous edges. However, for purposes of later description, the sheet may be understood as including generally opposed side edges 32.

At least one clip 38 is provided on the sheet 26, configured to releasably secure the sheet 26 to a desk 12 with the top writing surface 28 facing upwardly. The clip 38 may take any of several configurations that will enable fast and reliable release from and remounting of the sheet 26 to the desk 12.

Figure 3:
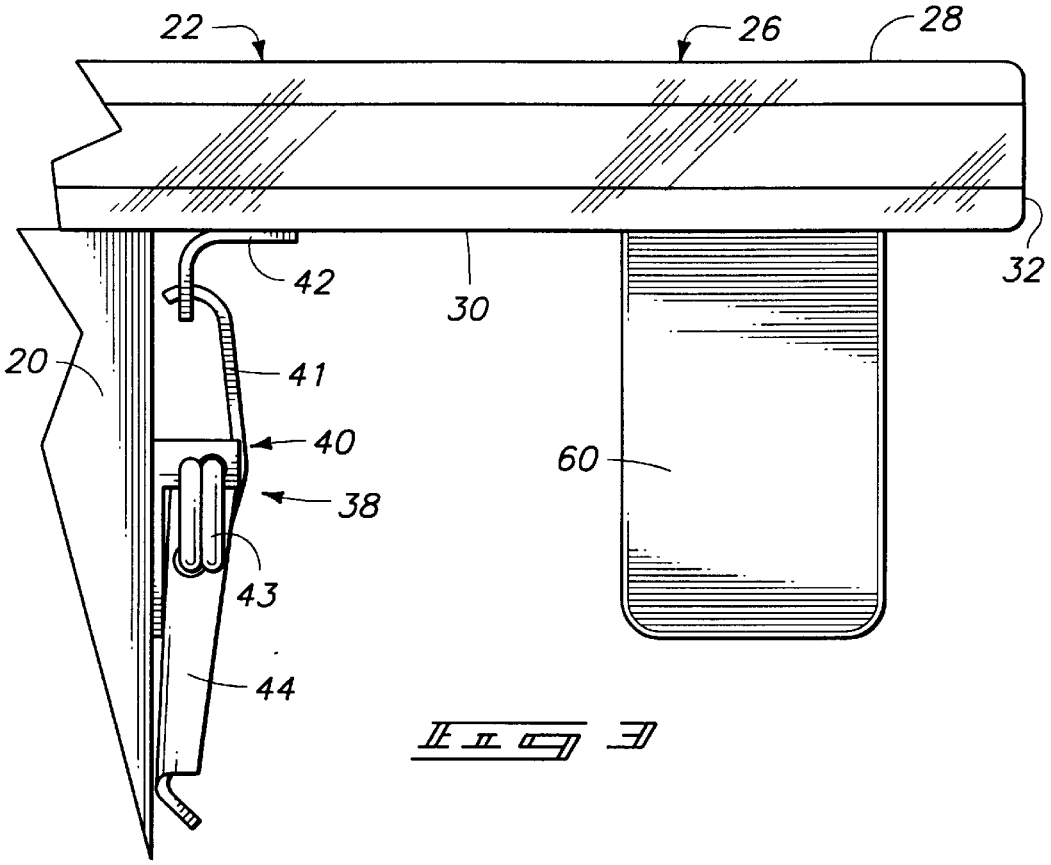
FIG. 3 is an enlarged fragmented detail view of a preferred clip for releasably securing the present shield to a desk.
Figure 4:
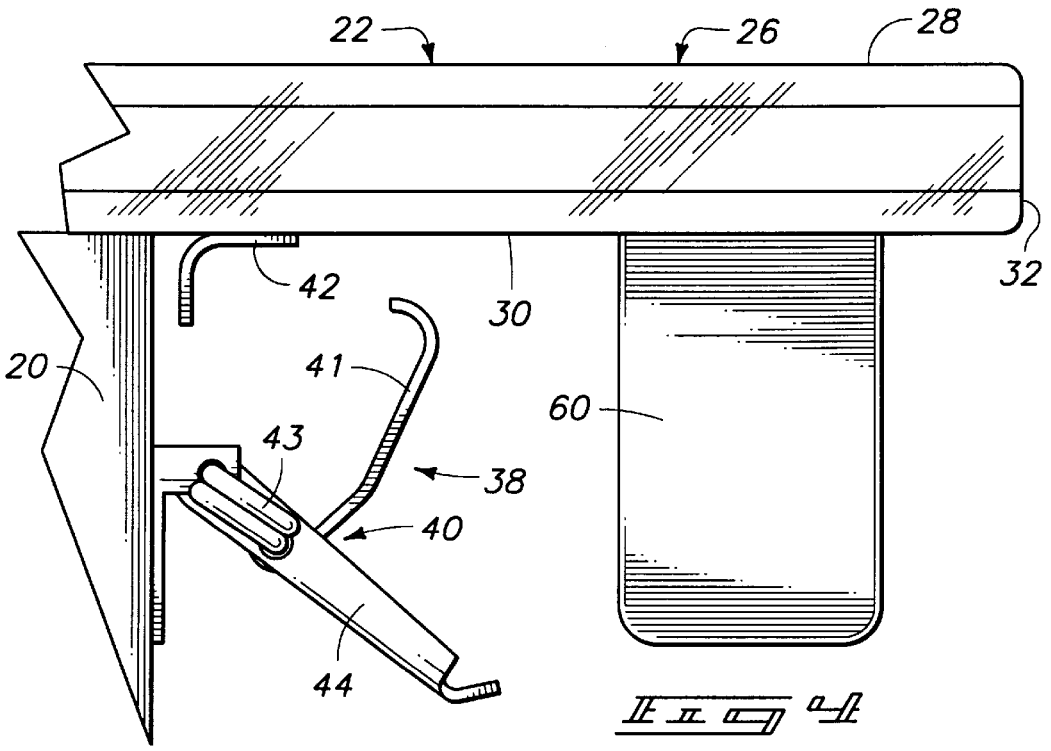
FIG. 4 is a view similar to FIG. 3 only showing the clip in a release position.

FIGS. 3 and 4 show a preferred example of a clip 38 in the form of a conventional manually operable buckle latch 40 which is mounted to the desk 12 and a catch 42 mounted to the sheet 26. This form of latch makes use of a hook 41 (FIGS. 3, 4) that is mounted by a spring 43 to an over-dead-center lever actuator 44.

The above form of buckle latch is commercially available. Specifically, a currently preferred example of such a latch is produced and distributed under the trademark "Versa Latch Series 200" by Southco, Inc. with Global Headquarters at 210 N. Brinton Lake Road, Concordville Pa. U.S.A., 19331-0116.

The hook 41 may be engaged with the associated catch 42 when the lever actuator 44 is upwardly disposed and the sheet is placed appropriately on the desk frame 14. When the lever actuator 44 is pivoted downwardly (FIG. 3), the hook 41 pulls the catch 42 down and deflects the spring 43 upwardly. The lever actuator 44 may be pivoted downwardly past a dead-center position, to effectively secure the sheet 26 to the desk.

To release the sheet, a user may grasp the lever actuator 44 and pull outwardly. The pre-tensioned spring 43 will snap the actuator past the over-dead-center position (FIG. 4) and immediately disengage the hook 41 from the catch 42, thereby allowing the sheet to be removed from the desk.

The above form of clip is useful on desks having compartment walls 20 as shown in FIGS. 1 and 2. The latch portion, including the hook 41, spring 43 and lever actuator 44 may be mounted to a compartment wall, and the catch 42 may be attached to the bottom surface 30 of the sheet. In fact it is most desirable for two such clips to be provided to releasably secure the sheet to the desk frame adjacent the opposed side edges 32. The clips are positioned to securely hold the sheet to the desk frame and for easy access by the user's hands for removal.

Figure 6:
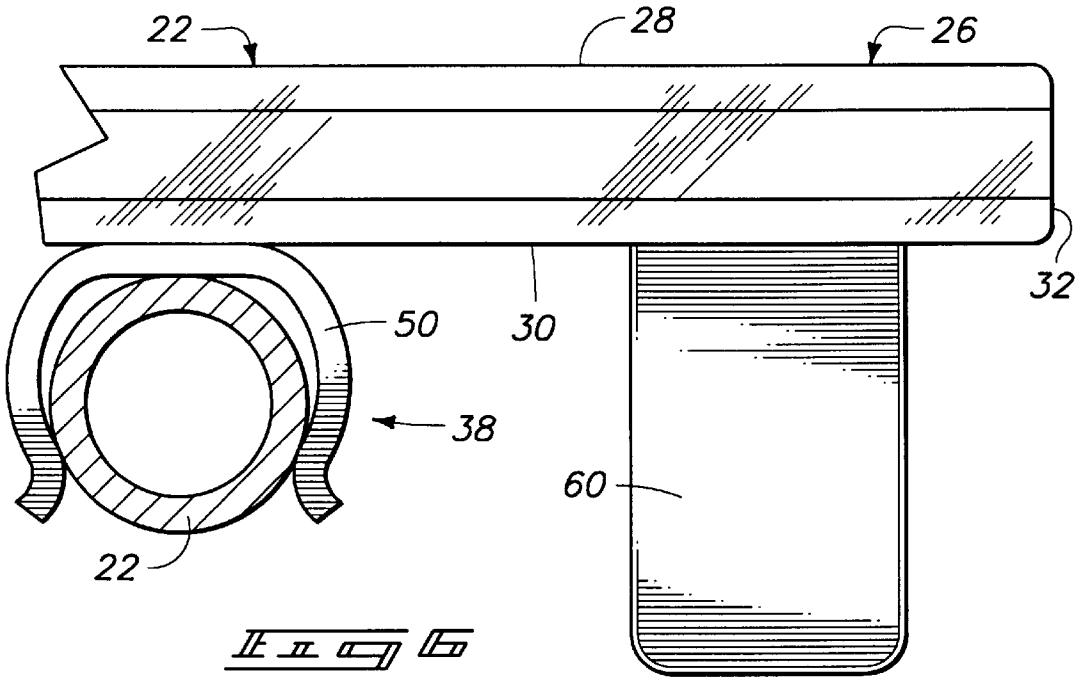
FIG. 6 is a detail view of an alternate form of clip for attachment to a desk frame of the type shown in FIG. 5.
Figure 7:
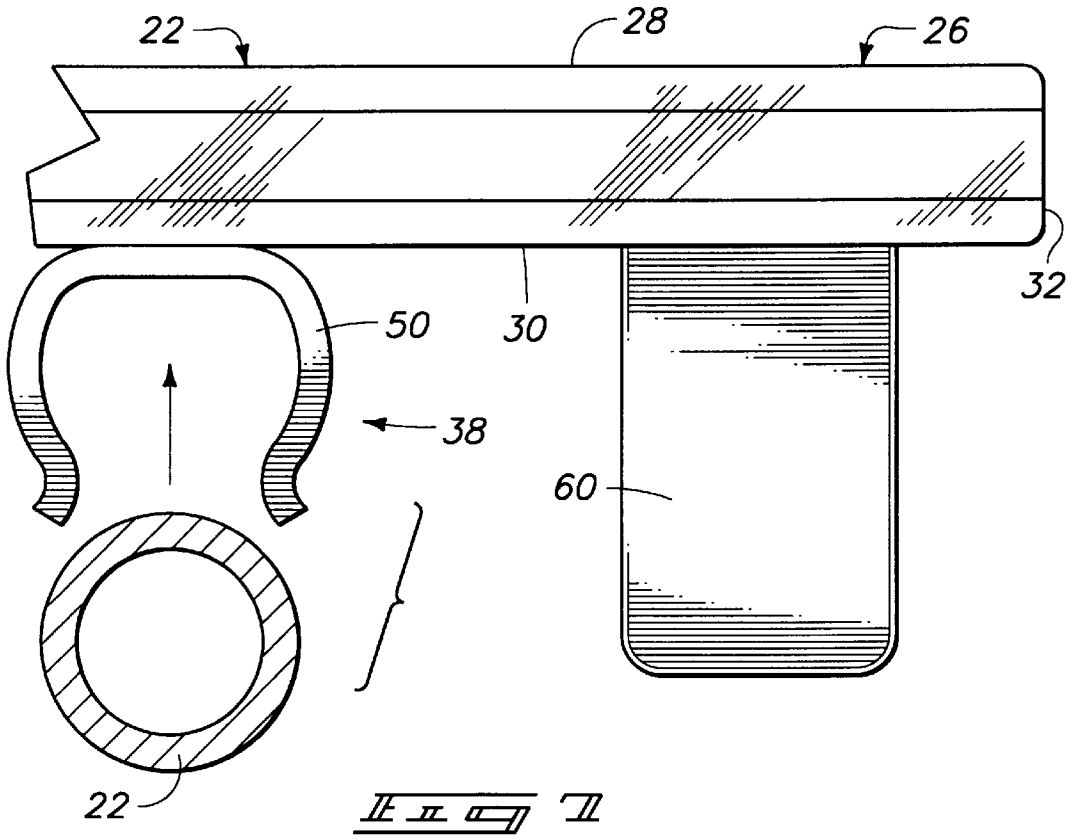
FIG. 7 is a view similar to FIG. 6 only showing the clip and desk top shield lifted upwardly.

Another exemplary form of clip is shown in FIGS. 5–7 to signify that numerous alternate forms of clips may be used, and to indicate adaptability of the present desk top shield 10 to different forms of desk frames.

The desk configuration shown generally in FIG. 5 does not include a compartment, but instead includes frame members 22 that may be of a tubular configuration, forming the horizontal top frame section. Accordingly, the clip 38 is provided in the form of a spring clasp 50 (FIGS. 6, 7) that is configured to be releasably secured to one of the frame members 22.

The clasp 50 may be formed of spring steel, or of an appropriate spring quality plastic in an inverted "U" configuration to mate with the cross-sectional shape of an appropriate one of the tubular frame members 22. The clasp 50 may be secured to the bottom surface 30 of the sheet in an orientation such that a sudden upward pull on the sheet will cause the sheet to be released from the desk. The clip is also located to position the sheet as a normal writing surface on the desk.

It is likely that several of the clasps 50 will be desirable in order to secure the sheet in a releasable yet secure position on the desk frame. If several such clasps 50 are used, all will be oriented to release in response to force being applied in a single general direction (preferably upwardly) as indicated by the arrow in FIG. 7.

It is possible that other clip configurations might also be used, depending upon the nature of the desk frame. For example, it is quite feasible that the clip be provided in the form of one or more locator pins 55 (FIG. 8) that may be provided on the sheet for alignment with appropriate holes 56 formed in the desk frame. Also, pins 57 (FIG. 9) could be provided on the desk frame 14 for reception in holes 58 provided in brackets 59 on the sheet. It is further possible that conventional snaps (not shown) could be used in place of the pins and holes.

The above are given as examples and it should be understood that still other forms of quick release fasteners could be used to releasably secure the sheet to a desk frame.

It is advantageous that forms of the present desk top shield will include at least one handle 60. Preferably two such handles 60 are provided as shown, on the bottom surface 30 of the sheet. The handles may be formed of various appropriate materials and be attached by conventional fastening techniques to the sheet. Alternatively, the handles may be formed integrally with the sheet. It is also possible for the handles to be made in various configurations. However the hand grip configurations shown are preferred to provide a secure grip for the user.

It is preferable that the handles 60 be positioned on the sheet inwardly adjacent the side edges 32. This locates the user's hands in safe positions when the shield is in use as shown in FIG. 2. The handles 60 are also preferably located adjacent to the clips 38 (especially with the clip embodiment shown in FIGS. 1–4) so the user's hands will directly engage or be situated immediately adjacent the handles 60 when the sheet is released from the desk frame. Thus the user will not be required to manipulate the sheet about to gain access to the handles 60.

In preferred forms the sheets 26 are dimensionally configured to overlap the desk top frame 18. This allows the sheet 26 to be mounted to the desk frame 14 with the handles positioned as shown (see FIGS. 3–9), outwardly of the desk frame members. This also allows the clips 38 to be positioned inwardly of the handles, between the adjacent desk frame members and handles 60 as shown. The handles 60 and clips 38 are thus located for ease of access by a person sitting at the desk, who may quickly access the clips 38 (if needed) and handles 60 for the purpose of removing the desk top shield from the desk frame.

The steps involved in retrofitting an existing desk with the present desk top shield are simple and straightforward. Most institutional desks are provided with tops that can be removed for repair or replacement. Thus a conventional desk may be prepared simply by removing the conventional desk top from the desk frame. This leaves the desk top mounting surface (the top frame section 18) exposed for reception of the present shield 10.

Subsequent attachment of the present desk top shield 10 may progress according to the nature of the clips 38 being used. The buckle latch type clip may be appropriately mounted by first positioning the sheet on the desk top frame in the desired location, then attaching the latch lever frames to the desk frame immediately below the bottom surface of the sheet. The catches 42 may be secured to the sheet by conventional fastening techniques and in appropriate positions for engagement by the latch hooks 41.

Of course the sheets may be produced with pre-positioned catches or clips for engagement with known desk frame configurations. In this situation, all that may remain to facilitate releasable mounting of the desk top shield to the desk is positioning and mounting of the latch lever and hook arrangements to the desk frame.

Figure 8:
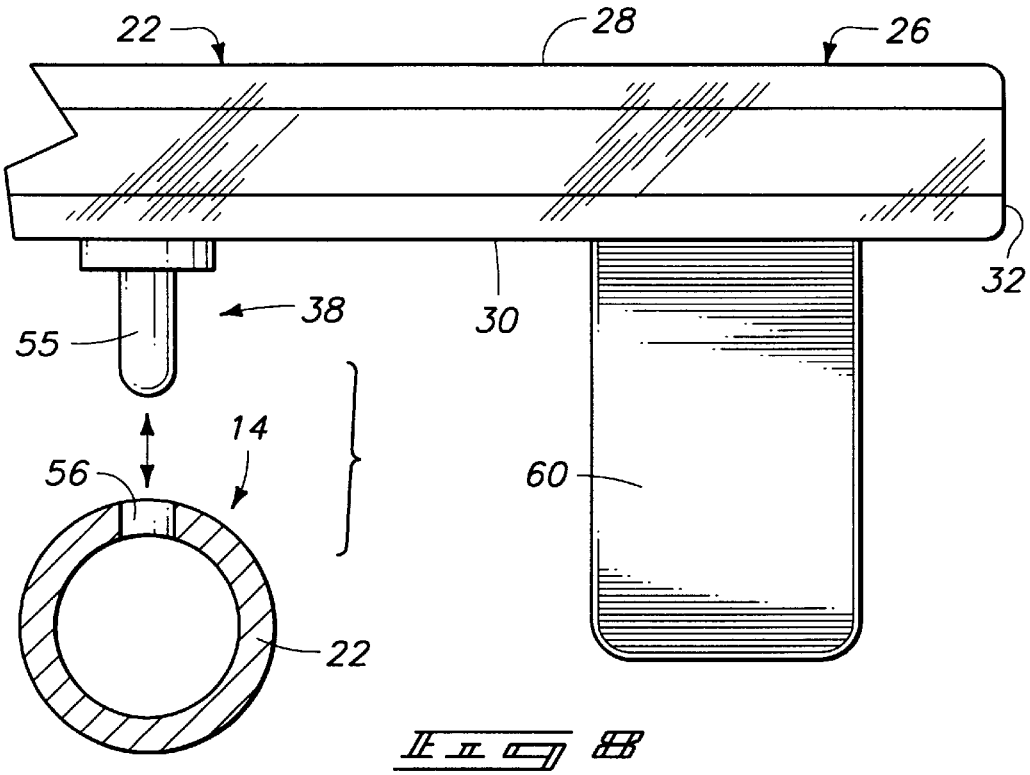
FIG. 8 is a view illustrating an alternate clip arrangement in the form of a pin.
Figure 9:
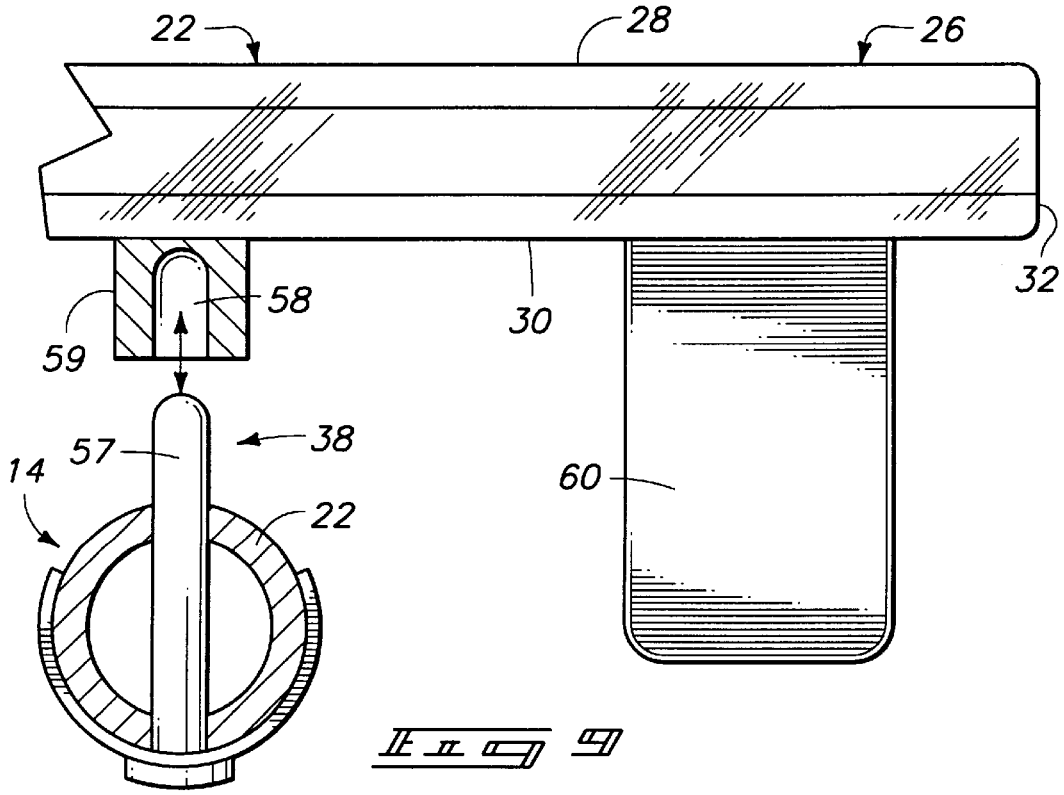
FIG. 9 is a view of another alternate clip arrangement.

If tubular desk frames are used, clip configurations such as exemplified in FIGS. 6–8 may be used. This may involve positioning and securing the clip members on the sheet (FIG. 8) in positions to engage appropriate parts of the desk frame, or by mounting the clip members to appropriate parts of the desk frame (FIG. 9).

Where the desk and removable shield are manufactured or assembled as a combination, appropriate conventional assembly procedures may be used at the assembly facility to position and mount the clips in a similar manner so the shield may be easily and quickly removed from the desk frame.

In normal use, the present removable shield will function in the same manner as a conventional desk top writing surface. The top surface 28 will be positioned at the same or similar level as a conventional desk top and the clips 38 will hold the shield against undesired lateral or horizontal movement. The shield thus presents an innocuous and non threatening appearance.

If a threatening situation occurs, a person sitting at or adjacent to the desk has an immediately available shield that can be accessed and deployed very quickly. This may be done according to the nature of the clips being used. For the embodiments in which the buckle latch 40 is used, the user simply pulls the latch levers 44 outwardly. The spring mechanisms will immediately spring the hooks from engagement with the catches 42 and allow the shield to be lifted from the desk. In embodiments where pins 55, 57 or spring clips 50 are used, the user may simply pull upwardly on the sheet with sufficient force to disengage the clips from the desk frame.

FIG. 2 shows the present shield deployed and in use. It is noted that the shield is held by the handles 60 and that the user's hands are protected by the shield. It is also noted that the shield is held in position to protect the user's vital organs. It is further noted that the transparent nature of the sheet will allow the user to see beyond the shield without risking exposure of vital organs. The otherwise ordinary desk top has thus become an effective shield for the user.

It is also noted that the present shield may be easily remounted, simply by placing the sheet on the desk frame and re-engaging the clips with associated parts of the desk frame. This again establishes the shield as a desk top. The ease in which the shield is removed from and remounted to a desk facilities organized safety training procedures and drills in which users may be periodically instructed in the use of the shield.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A desk with a removable bullet resistant desk top shield, comprising:

a desk frame including upright legs and a substantially horizontal top frame section;

a sheet of bullet resistant material having a top writing surface and a bottom surface; and at least one clip releasably securing the sheet to the top frame section with the top writing surface facing upwardly.

2. A desk as claimed by claim 1 wherein said sheet is transparent.

3. A desk as claimed by claim 1 wherein said at least one clip is situated on the bottom surface.

4. A desk as claimed by claim 1 further comprising at least one handle on the bottom surface and wherein said at least one clip is situated on the bottom surface adjacent said at least one handle.

5. A desk as claimed by claim 1 wherein the sheet includes opposed side edges and wherein at least one handle is positioned adjacent one of the opposed side edges.

6. A desk as claimed by claim 1 wherein the sheet includes opposed side edges and wherein at least one handle is positioned adjacent one of the opposed side edges and wherein said at least one clip is situated adjacent said at least one handle and spaced therefrom toward a remaining one of the opposed side edges.

7. A desk as claimed by claim 1 wherein said at least one clip is comprised of a manually operable buckle latch mounted to the desk frame and a catch mounted to the sheet and positioned thereon to be releasably engaged by the buckle latch.

8. A desk as claimed by claim 1 wherein the top frame section is formed by tubular members and wherein said at least one clip is comprised of a spring clasp configured to releasably clamp over one of the tubular members.

9. A desk as claimed by claim 1 wherein said at least one clip is comprised of a spring clasp configured to releasably clamp a portion of the desk and positioned on the sheet to selectively clasp and release the desk in response to movement of the sheet in a directional path substantially normal to the top surface.

10. A desk as claimed by claim 1 wherein the sheet is comprised of laminated polycarbonate plastic.

* * * * *